US006939193B1

(12) United States Patent
McDowell et al.

(10) Patent No.: US 6,939,193 B1
(45) Date of Patent: Sep. 6, 2005

(54) AQUATIC GAME DEVICE

(76) Inventors: William C. McDowell, 4007 159th Street Ct. East, Tacoma, WA (US) 98446; Melissa McDowell, 4007 159th Street Ct. East, Tacoma, WA (US) 98446

( * ) Notice: Subject to any disclaimer, the term of this patent is extended or adjusted under 35 U.S.C. 154(b) by 0 days.

(21) Appl. No.: 10/897,367

(22) Filed: Jul. 22, 2004

(51) Int. Cl.[7] ..... A63H 23/00

(52) U.S. Cl. ..... 446/153; 446/253; 482/110; 273/440; 273/451

(58) Field of Search ..... 446/153, 253–254; 273/440, 451; 239/145, 196, 289, 323, 326–329; 482/44, 92–93, 98–99, 110, 148, 906, 909

(56) References Cited

U.S. PATENT DOCUMENTS 3,069,162 A * 12/1962 Samuel ..... 482/110
3,985,360 A 10/1976 Meyer ..... 272/109
4,060,240 A 11/1977 Dunston ..... 272/126
4,138,798 A 2/1979 Washington ..... 46/59
4,212,460 A 7/1980 Kraft ..... 273/58 B
5,288,256 A * 2/1994 Lee et al. ..... 446/48
5,624,294 A * 4/1997 Chen ..... 446/253
6,482,137 B2 * 11/2002 Walker ..... 482/110

* cited by examiner

*Primary Examiner*—Derris H. Banks
*Assistant Examiner*—Urszula M. Cegielnik
(74) *Attorney, Agent, or Firm*—Sturm & Fix LLP

(57) ABSTRACT

A game device (10) for spraying water on at least a pair of players wherein, the game device (10) includes a hollow generally spherical housing member (20) having a hollow axial cylinder 25 wherein, the opposite ends of the housing member (20) are provided with a plurality of spray apertures (24) and the exterior of the axial cylinder (25) is operatively associated with a compression plate member (33) and a pair of water saturated sponge members (31) (31) and the interior of the hollow axial cylinder (25) is adapted to receive tether means (50) (50) for shuttling the housing member (20) back and forth between the players.

8 Claims, 2 Drawing Sheets

AQUATIC GAME DEVICE

CROSS REFERENCE TO RELATED APPLICATIONS

This invention was the subject matter of Document Disclosure Program Registration Number 546,191, filed in the United States Patent and Trademark Office on Feb. 2, 2004.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of games in general and in particular to games that have an exercise component, as well as, an aquatic component.

2. Description of Related Art

As can be seen by reference to the following U.S. Pat. Nos. 4,138,798; 3,985,360; 4,212,460; and, 4,060,240, the prior art is replete with both exercise devices, as well as, games that employ a spherical component.

While all of the aforementioned prior art constructions are more than adequate for the basic purpose and function for which they have been specifically designed, they are uniformly deficient with respect to their failure to provide a simple, efficient, and practical aquatic game device wherein, two players sequentially douse one another with spray as they propel a hollow spherical object between one another.

While there are many poolside accessories that well deliver a cooling spray to young children and adults, to date no one has developed a practical device that provides both a cooling spray plus exercise for the users; and, one which also can be employed for the enjoyment and amusement of those children not privileged enough to have access to a pool, lake or other body of water.

As a consequence of the foregoing situation, there has existed a longstanding need across the country for a new and improved aquatic game device that provides both a cooling spray and exercise for the users; and the provision of such a construction is a stated objective of the present invention.

BRIEF SUMMARY OF THE INVENTION

Briefly stated, the game device comprises a housing unit containing a mass transfer unit wherein, both the housing unit and the mass transfer unit are operatively associated with one another, as well as, an actuator unit which propels the housing unit between the users of the device.

As will be explained in greater detail further on in the specification, the housing unit comprises a generally spherical shaped hollow housing member equipped with a hollow axial cylinder which supports the mass transfer unit and which is further adapted to slidably receive portions of the actuator unit wherein, the opposite ends of the housing member are provided with a plurality of spray apertures.

In addition, the mass transfer unit comprises a pair of stop plates fixedly secured to the hollow axial cylinder of the housing member and a pair of sponge members and a compression plate member that are slidably disposed on the axial cylinder of the housing member such that the compression plate member will expel water from each of the sponge members in turn as the actuator unit causes the housing member to travel back and forth between the players of the game.

Furthermore, the actuator unit includes a pair of elongated tethers that are threaded through the axial cylinder of the housing member and each provided with a pair of handle elements on their distal and proximal ends wherein, one player grasps the distal handle elements and the other player grasps the proximal handle elements to propel the game device back and forth between the players.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
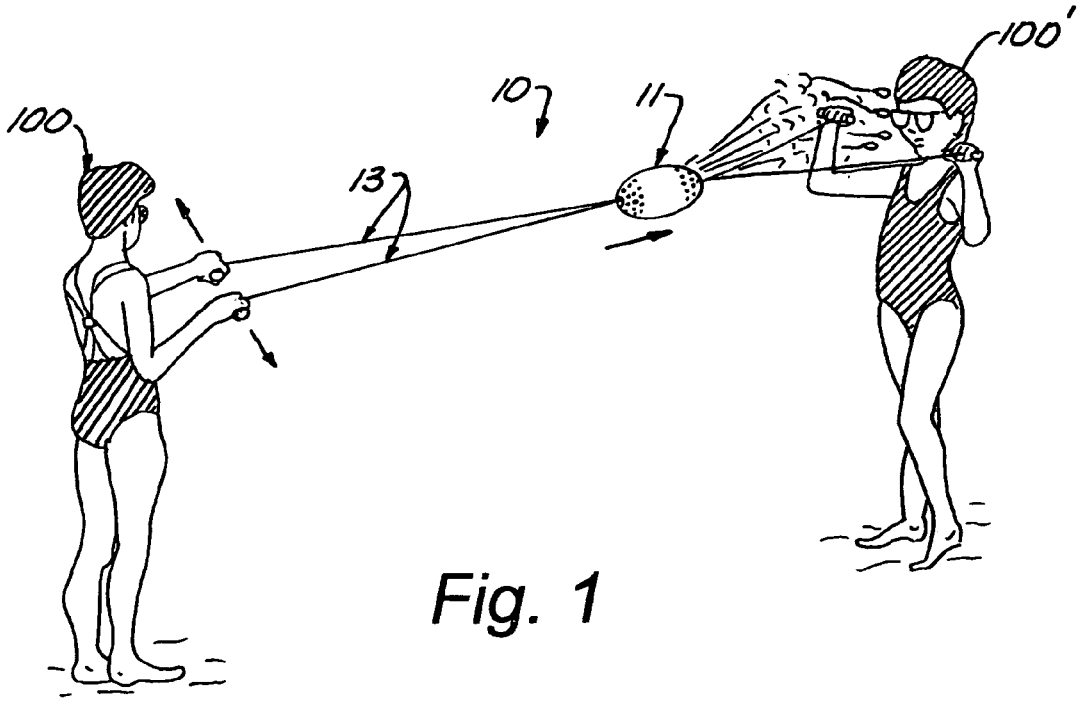
FIG. 1 is a perspective view of the aquatic game device in use.

As can be seen by reference to the drawings, and in particularly to FIG. 1, the aquatic game device that forms the basis of the present invention is designated generally by the reference number 10. The game device 10 comprises in general a housing unit 11, a mass transfer unit 12, and an actuator unit 13. These units will now be described in seriatim fashion.

Figure 2:
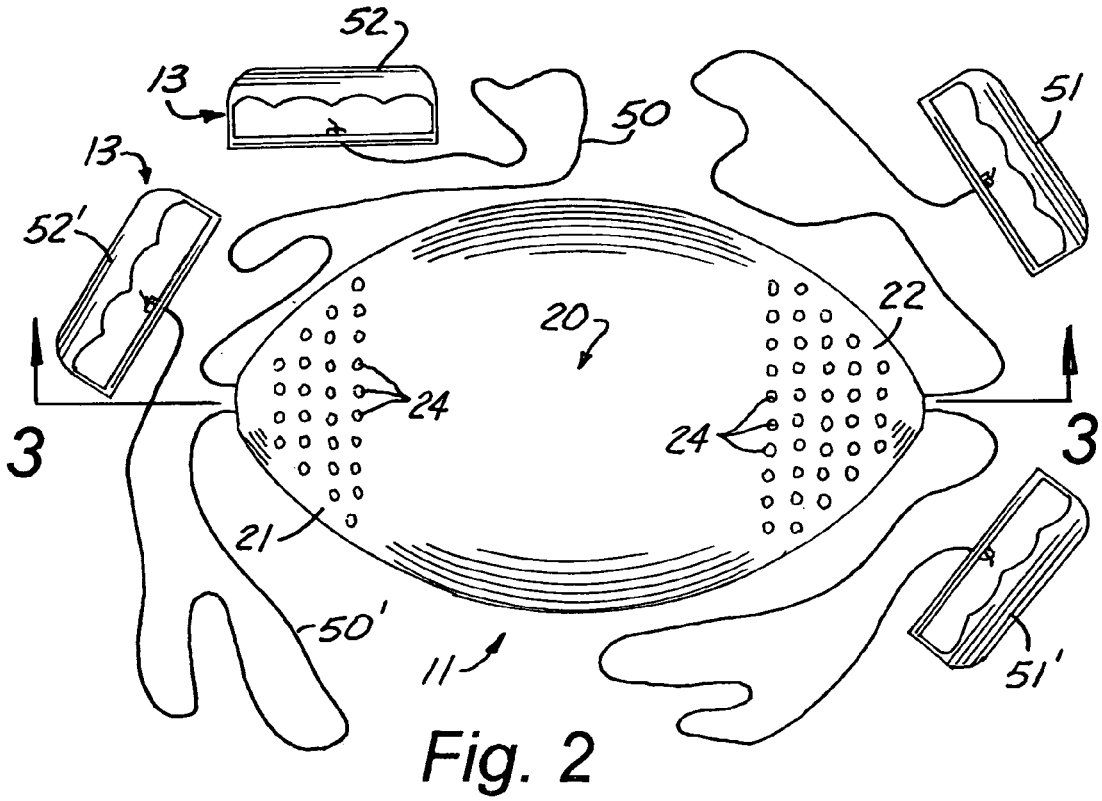
FIG. 2 is a perspective view of the visible components of the game device.
Figure 3:
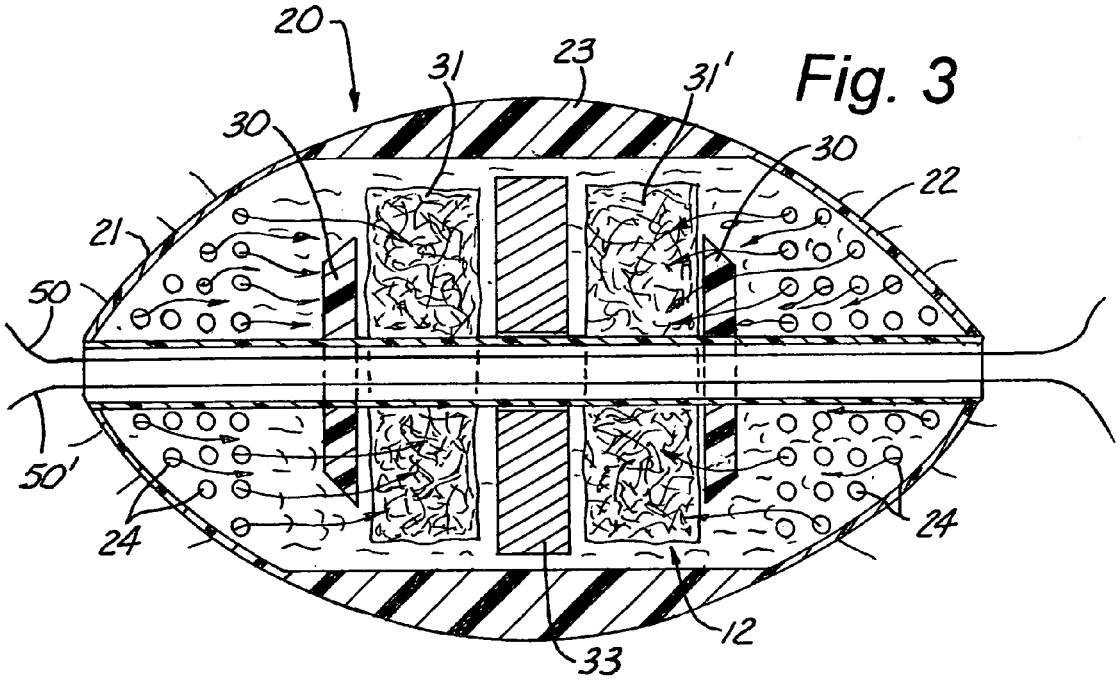
FIG. 3 is a cross sectional view through line 3—3 of FIG. 2 showing the device being pre-loaded with water.

As shown in FIGS. 2 and 3, the housing unit 11 comprises a hollow housing member 20 having an elongated spherical shape wherein, the opposite ends 21 22 of the hollow housing member 20 are provided with a plurality of spray apertures 24 and the intermediate portion 23 is provided with a smooth, curved, uninterrupted exterior surface.

In addition, the interior of the hollow housing member 20 is further provided with an elongated hollow axial cylinder 25 the purpose and function of which will be described presently.

Figure 4:
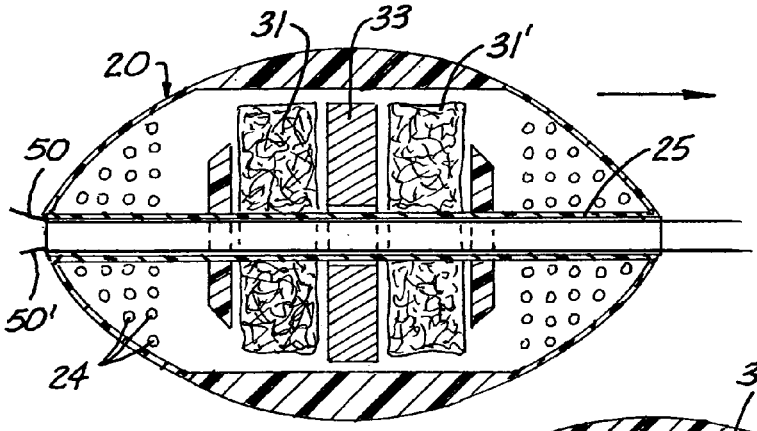
FIG. 4 is a cross-sectional view similar to FIG. 3 depicting the mass transfer unit in its quiescent state.
Figure 5:
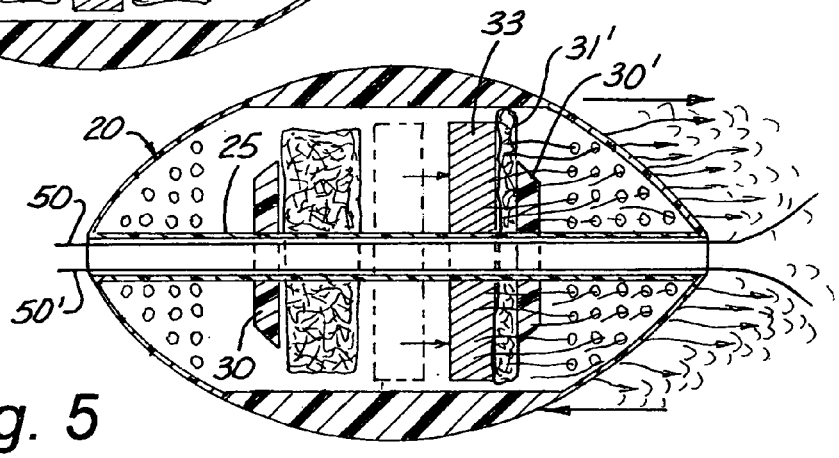
FIG. 5 is a cross-sectional view of the components of the mass transfer unit as the compression plate member expels water from one of the sponge members.

Turning now to FIGS. 3 through 5, it can be seen that the mass transfer unit 12 comprises a pair of stop plate members 30 30' fixedly secured to the exterior of the hollow axial cylinder 25 plus a pair of sponge members 31 31' and a compression plate member 33 that are slidably disposed on the axial cylinder 25 intermediate the stop plate members 30 30 wherein, the sponge members 31 are disposed on opposite sides of the compression plate member 33.

Furthermore, in the preferred embodiment of this invention, all of the components of the mass transfer unit 13 are provided with a generally disk shaped configuration for reasons that will become apparent further on in the specification.

As can also be best appreciated by reference to FIGS. 2 and 3, the actuator unit 13 comprises a pair of elongated flexible tether members 50 50' wherein, the opposite ends of each of the tether members 50 50' have a proximal handle element 51 51' and a distal handle element 52 52'.

Turning now to FIGS. 1, and 3 through 5, it can be seen that the device 10 is first pre-loaded by submerging the housing member 20 in water which enters through the spray apertures to soak the sponge members 31 31 as depicted in FIG. 3.

Then one player 100 grasps the distal handle elements 52 52' and the other player 100' grasps the proximal handle elements 51 51' and the housing member 20 is positioned on the tether members 50 50' closest to the player 100 that will begin the game.

That player 100 then quickly spreads their arms out to the sides to rapidly propel the housing unit 11 toward the other player 100'. The other player 100' responds to the approach of the housing unit 11 by likewise spreading their arms out to the side which will slow the approach of the housing unit 11.

However, as the velocity of the housing member 20 slows, the compression plate member 33 continues to accelerate until it impacts against the sponge member 31' closest to the second player 100' whereupon the compression plate member 33 will cause a quantity of water to be expelled from the sponge member 31' as the sponge member 31' is squeezed between the compression plate member 33 and the stop plate member 31'.

Once the second player 100' has been sprayed, they can return the favor by reversing the process and this can continue until both sponge members 31 31' have been depleted of this supply of water.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A game device for spraying a quantity of water on at least two players wherein, the game device comprises:

a housing unit including a generally spherical hollow housing member having opposite ends that are provided with a plurality of spray apertures;

a weight transfer unit at least partially movably disposed within the hollow housing member and including a compression plate member disposed intermediate a pair of sponge members; and, an actuator unit including tether means for moving the housing member in a reciprocating fashion back and forth between the players.

2. The game device as in claim 1; wherein, said housing member is further provided with a hollow axial cylinder.

3. The game device as in claim 2; wherein, the pair of sponge members and the compression plate member are adapted to be slidably displaced relative to the exterior of the hollow axial cylinder.

4. The game device as in claim 3; wherein, the interior of the hollow axial cylinder is dimensioned to slidably receive a portion of said tether means.

5. The game device as in claim 3; wherein, said mass transfer unit further includes a pair of stop plate members fixedly secured to the exterior of the hollow axial cylinder and disposed in a flanking orientation relative to the pair of sponge members and the compression plate member.

6. The game device as in claim 4; wherein, said mass transfer unit further includes a pair of stop plate members fixedly secured to the exterior of the hollow axial cylinder and disposed in a flanking orientation relative to the pair of sponge members and the compression plate member.

7. The game device as in claim 5; wherein, said tether means comprises a pair of elongated tether members wherein, each tether member is provided with a pair of handle elements disposed on its opposite ends.

8. The game device as in claim 6; wherein, said tether means comprises a pair of elongated tether members wherein, each tether member is provided with a pair of handle elements disposed on its opposite ends.

* * * * *